US005323501A

United States Patent [19]

Kuhangel

[11] Patent Number: 5,323,501

[45] Date of Patent: Jun. 28, 1994

[54] MATTRESS COVER

[76] Inventor: Gerhard H. Kuhangel, 702 Twin Towers North, Beach Road, Sea Point 8001, South Africa

[21] Appl. No.: 974,078

[22] Filed: Nov. 10, 1992

[51] Int. Cl.[5] ..... A47G 9/02

[52] U.S. Cl. ..... 5/499; 5/470

[58] Field of Search ..... 5/470, 485, 486, 499, 5/500, 497

[56] References Cited

U.S. PATENT DOCUMENTS

| | | | |
|---|---|---|---|
| Re. 24,591 | 1/1959 | Schwartz . | |
| 2,179,175 | 11/1939 | Cohen, Jr. | 5/499 |
| 2,528,313 | 10/1950 | Kessler | 5/497 |
| 2,861,280 | 11/1958 | Sachs . | |
| 2,879,524 | 3/1959 | Eisen . | |
| 2,907,055 | 10/1959 | Berman . | |
| 2,924,833 | 2/1960 | Klogether . | |
| 3,601,826 | 8/1971 | Smith . | |
| 3,605,143 | 9/1971 | Smith . | |
| 3,636,575 | 1/1972 | Smith | 5/499 |
| 3,832,743 | 5/1972 | Smith . | |
| 4,136,413 | 1/1979 | Scales | 5/497 X |
| 4,317,244 | 3/1982 | Balfour-Ritchie | 5/500 X |
| 4,606,290 | 8/1986 | Marzotto . | |

FOREIGN PATENT DOCUMENTS

| | | |
|---|---|---|
| 0006952 | 1/1980 | European Pat. Off. . |
| 1144450 | 2/1963 | Fed. Rep. of Germany . |
| 7139792 | 10/1971 | Fed. Rep. of Germany . |
| 1654225 | 3/1972 | Fed. Rep. of Germany . |
| 2124367 | 11/1972 | Fed. Rep. of Germany . |
| 2804534 | 8/1979 | Fed. Rep. of Germany . |
| 3006954 | 9/1981 | Fed. Rep. of Germany . |
| 8700571 | 1/1987 | Fed. Rep. of Germany . |
| 8908352 | 10/1989 | Fed. Rep. of Germany . |
| 9113347 | 10/1991 | Fed. Rep. of Germany . |
| 777157 | 6/1957 | United Kingdom . |
| 1168565 | 10/1969 | United Kingdom . |

*Primary Examiner*—Michael F. Trettel
*Attorney, Agent, or Firm*—Larson and Taylor

[57] ABSTRACT

Mattresses conventionally are covered by bed sheets having a size to extend beyond the borders of a mattress on which it is to be placed so that its projecting edges may be tucked under the mattress. It is often difficult to apply a sheet smoothly and, in particular when a person is resting or sleeping on the mattress, the sheet may be pulled out from under the mattress and be displaced. The invention suggests a mattress cover in the form of a sleeve, which includes a top sheet; two opposite end walls and two opposite elongated side walls joined to the top sheet. It has flaps extending from the end walls and side walls and a bottom sheet joined to the flaps. An elongated open section is provided between adjacent edges of the bottom sheet and a flap of one of the side walls and a flap of at least one of the end walls, defining an opening through which a mattress can be inserted into the sleeve. Detachable fastening means are provided for fastening the adjoining edges of the bottom sheet and side wall and end wall along the opening together.

3 Claims, 1 Drawing Sheet

MATTRESS COVER

FIELD OF INVENTION

The present invention relates to mattress covers.

BACKGROUND OF INVENTION

Mattresses conventionally are covered by bed sheets. Such a bed sheet normally has a size to extend beyond the borders of a mattress on which it is to be placed so that its projecting edges may be tucked under the mattress.

It is often difficult to apply a sheet smoothly and, in particular when a person is resting or sleeping on the mattress, the sheet may be pulled out from under the mattress and be displaced.

It is an object of the invention to suggest a mattress cover which will assist in overcoming this problem.

SUMMARY OF INVENTION

According to the invention, there is provided a mattress cover in the form of a bed sheet shaped as a sleeve made of a single sheet of material for covering a mattress having a top surface, a bottom surface, two opposite end wall surfaces and two opposite side wall surfaces, the sleeve including:

(a) a top sheet for covering the top surface of the mattress;

(b) two opposite end walls for covering the opposite end wall surfaces of the mattress;

(c) two opposite elongated side walls for covering the opposite side wall surfaces of the mattress; and (d) four flaps extending respectively from the end walls and the side walls towards each other for covering an underside border part of the mattress extending from the opposite side and end walls of the mattress; the mattress cover further including:

(e) a bottom sheet made of a material different from the sleeve and having a width and a length less than the width and length of the top sheet and being joined to the flaps so as to, in use, cover that part of the underside of the mattress not covered by the flaps;

(f) an elongated open section between adjacent edges of the bottom sheet and a flap of one side of at least one of the side walls and a flap of at least one of the end walls, the open section defining an opening through which the mattress can, in use, be inserted into the sleeve; and (f) detachable fastening means for detachably fastening together the adjoining edges of the bottom sheet, the side wall and the end wall along the opening.

The material of the bottom sheet may be a gauze fabric.

The detachable fastening means may be constituted by hook and loop fastener strips.

BRIEF DESCRIPTION OF DRAWINGS

The invention will now be described by way of example with reference to the accompanying schematic drawings.

In the drawings there is shown in:

FIG. 4 a view onto the mattress cover in lay-flat form and prior to be joined together to form a sleeve;

DETAILED DESCRIPTION OF DRAWINGS

Figure 1:
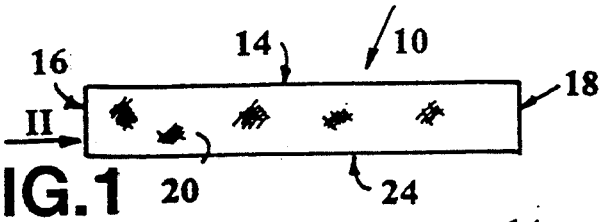
FIG. 1 an end view of a mattress provided with a mattress cover according to the invention.
Figure 2:
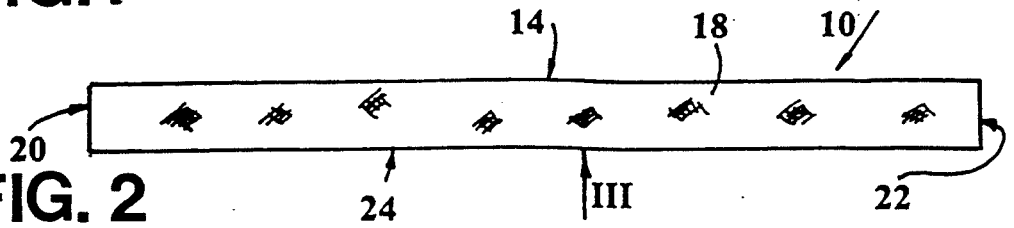
FIG. 2 a side view seen along arrow II in FIG. 1.

Referring to FIGS. 1 to 5, the mattress cover in accordance with the invention, generally indicated by reference numeral 10, is shown as fitted over a mattress 12.

The mattress cover 10 is in the form of a sleeve having an upper part 14, side walls 16, 18, end walls 20, 22 and a bottom part 24.

The bottom part 24 is formed by elongated side flaps 26, 28 of the walls 16, 18 and, end flaps 30, 32 of the walls 20, 22 and a bottom sheet 34.

The upper sheet 14, side walls 16, 18, end walls 20, 22 and flaps 26, 28, 30, 32 are made conventional bed sheet material or so-called stretch material. The panel 34 is made of another type of material, which can be of a cheaper type, such as a gauze or netting type of material. Thereby a saving in the overall material cost of the cover 10 is achieved.

The sheet 34 is joined along its edges to the flaps 26, 28, 30, 32, e.g. by sewing, but an opening is provided along the section indicated by dotted lines 36, 38. The section 36 extends along the full length of the flap 30 and the section 38 only along part of the length of the flap 28 so that, when the sheet 34 is folded over along the line 40 in the direction of arrow 42 an opening 44 is formed.

Figure 5:
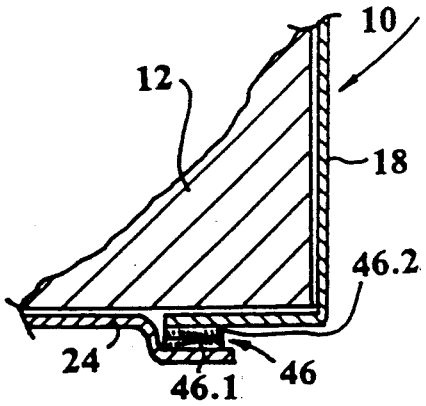
FIG. 5 on an enlarged scale, a sectional view of part of the mattress and mattress cover seen along arrows IV—IV in FIG. 3.

Releasable fastener strips or elements 46, 48, 50, 52, 54, 56, 58 are provided at the positions indicated. These fastener strips 46 . . . 58 are in the form of so-called Velcro fastener strips of which one part 46.1 . . . 58.1 is attached to the edge of the sheet 34 and the cooperating other part 46.2 . . . 58.2 to the flap 30 or 28 as shown in FIG. 5. The strips 46 . . . 58 may be of square block shape. However, the fastener strips 46 . . . 56 also may be constituted by zip fasteners or press buttons.

Figure 3:
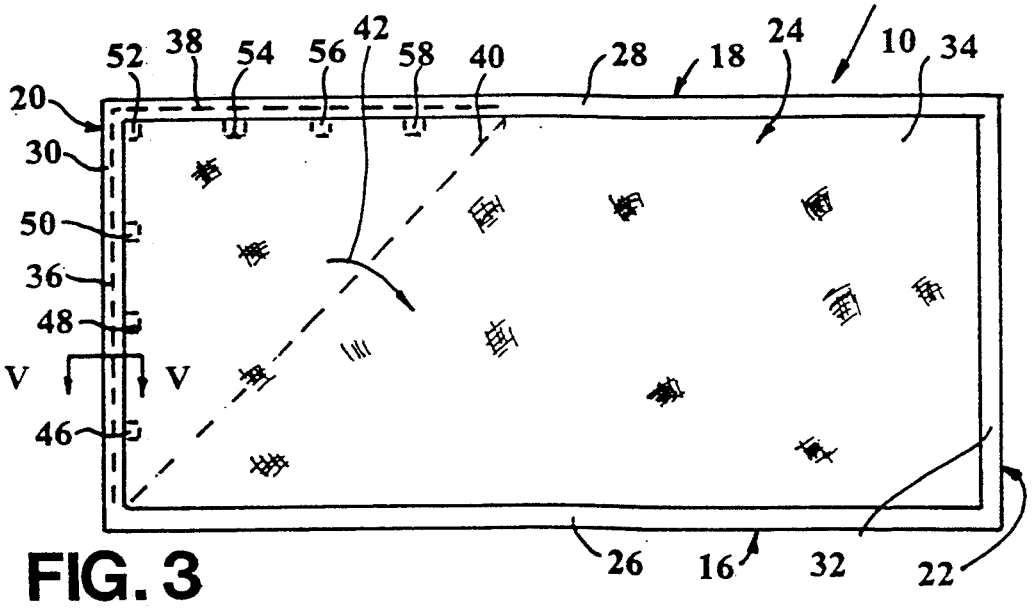
FIG. 3 a view from below seen along arrow III in FIG. 2.

In FIG. 3 the mattress cover 10 is shown in layflat form prior to being joined together to form a sleeve. The folding lines between the sheet 14 and the walls 16 . . . 24 is indicated by dotted lines 60.1 . . . 60.4 and between the walls 16 . . . 24 and the flaps 26 . . . 32 by dotted lines 62.1 . . . 62.4. The free edges of the flaps 26 . . . 32 are folded (for a distance of about 1 mm) to be sewn together.

Figure 6:
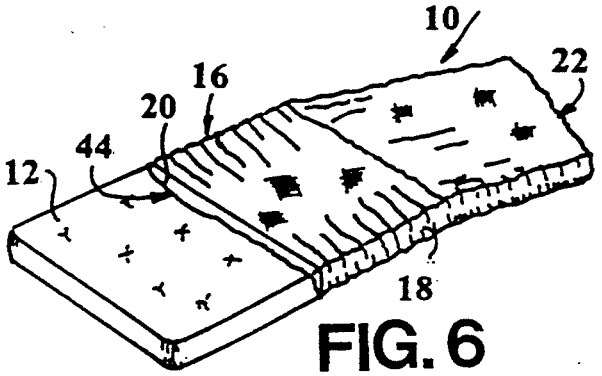
FIG. 6 a pictorial view of the mattress cover in accordance with the invention being pulled over a mattress.

As shown in FIG. 6, the mattress 12 is inserted through the opening 44 into the cover 10. When the cover 10 has been pulled over the mattress, the fastener strips 46 . . . 58 are pressed together for fastening the sheet 34 to the flaps 30, 28.

As the fastener strips 46 . . . 56 are on the underside of the mattress they are not visible from the outside and an attractive appearance of the mattress cover 10 results. The tight fitting of the cover 10 also ensures that it cannot be pulled loose during the night. Furthermore it prevents easy unauthorized removal, e.g. in hotels or hospitals.

The cover 10 has particular useful application in hotels, hospitals, hostels, dormitories and other places.

I claim:

1. A mattress cover in the form of a bed sheet shaped as a sleeve made of a single sheet of material for covering a mattress having a top surface, a bottom surface, two opposite end wall surfaces and two opposite side wall surfaces, the sleeve including:

(a) a top sheet for covering the top surface of the mattress;

(b) two opposite end walls for covering the opposite end wall surfaces of the mattress;

(c) two opposite elongated side walls for covering the opposite side wall surfaces of the mattress; and (d) four flaps extending respectively from the end walls and the side walls towards each other for covering an underside border part of the mattress extending from the opposite side and end walls of the mattress; the mattress cover further including:

(e) a bottom sheet made of a material different from the sleeve and having a width and a length less than the width and length of the top sheet and being joined to the flaps so as to, in use, cover that part of the underside of the mattress not covered by the flaps;

(f) an elongated open section between adjacent edges of the bottom sheet and a flap of one side of at least one of the side walls and a flap of at least one of the end walls, at least a portion of at least two edges of said bottom sheet being permanently secured to corresponding flaps of the sleeve so as to enable receipt of a mattress inserted therein and the open section defining an opening through which the mattress can, in use, be inserted into the sleeve; and (g) detachable fastening means for detachably fastening together the adjacent edges of the bottom sheet, the side wall and the end wall along the opening.

2. A cover as claimed in claim 1, in which the material of the bottom sheet comprises a gauze fabric.

3. A cover as claimed in claim 1, in which the detachable fastening means comprise hook and loop fastener strips.

* * * * *